US005538469A

United States Patent [19]

Kwon et al.

[11] Patent Number: 5,538,469

[45] Date of Patent: Jul. 23, 1996

[54] COIN TREATMENT APPARATUS

[75] Inventors: Soon H. Kwon; Eun H. Kim; Byung W. Jin; Woon Y. Joo, all of Seoul, Rep. of Korea

[73] Assignee: Korea Telecommunication Authority, Rep. of Korea

[21] Appl. No.: 196,143

[22] PCT Filed: Jun. 18, 1993

[86] PCT No.: PCT/KR93/00050

§ 371 Date: Jun. 27, 1994

§ 102(e) Date: Jun. 27, 1994

[87] PCT Pub. No.: WO94/00828

PCT Pub. Date: Jan. 6, 1994

[30] Foreign Application Priority Data

Jun. 19, 1992 [KR] Rep. of Korea ..... 1992-10646

[51] Int. Cl.[6] ..... G07D 3/14

[52] U.S. Cl. ..... 453/3; 453/21

[58] Field of Search ..... 453/3, 4, 9, 15, 453/19, 20, 21, 23, 24, 26, 37, 41; 194/346, 317, 318, 319

[56] References Cited

U.S. PATENT DOCUMENTS

| | | | |
|---|---|---|---|
| 4,286,703 | 9/1981 | Schuller et al. | 194/346 X |
| 4,364,404 | 12/1982 | Hayashi et al. | 453/20 |
| 4,731,818 | 3/1988 | Clark, Jr. et al. | 379/144 |
| 4,878,573 | 11/1989 | Kobayashi et al. | 453/15 X |
| 5,184,709 | 2/1993 | Nishiumi et al. | 194/346 X |

FOREIGN PATENT DOCUMENTS

| | | | |
|---|---|---|---|
| 0185365 | 6/1986 | European Pat. Off. . | |
| 500366 | 8/1992 | European Pat. Off. | 194/317 |
| 63-290449 | 11/1988 | Japan . | |

*Primary Examiner*—F. J. Bartuska

*Attorney, Agent, or Firm*—Merchant, Gould, Smith, Edell, Welter & Schmidt

[57] ABSTRACT

A coin treatment apparatus is disclosed that includes structure for selecting the inserted coins based upon their size, in accordance with their specific currency units, and transferring the coins to a receiving space. Once in the receiving space, coins of the correct currency unit are moved to their respective receiving containers within a receiving box. Coins that are not of the correct currency unit are transferred to a separate receiving space and discharged from the apparatus.

10 Claims, 5 Drawing Sheets

FIG. 2
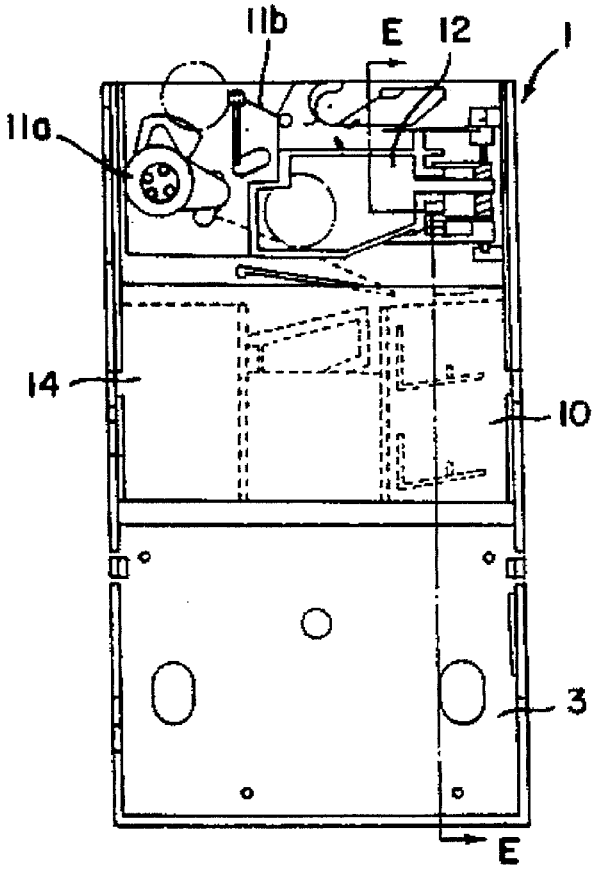
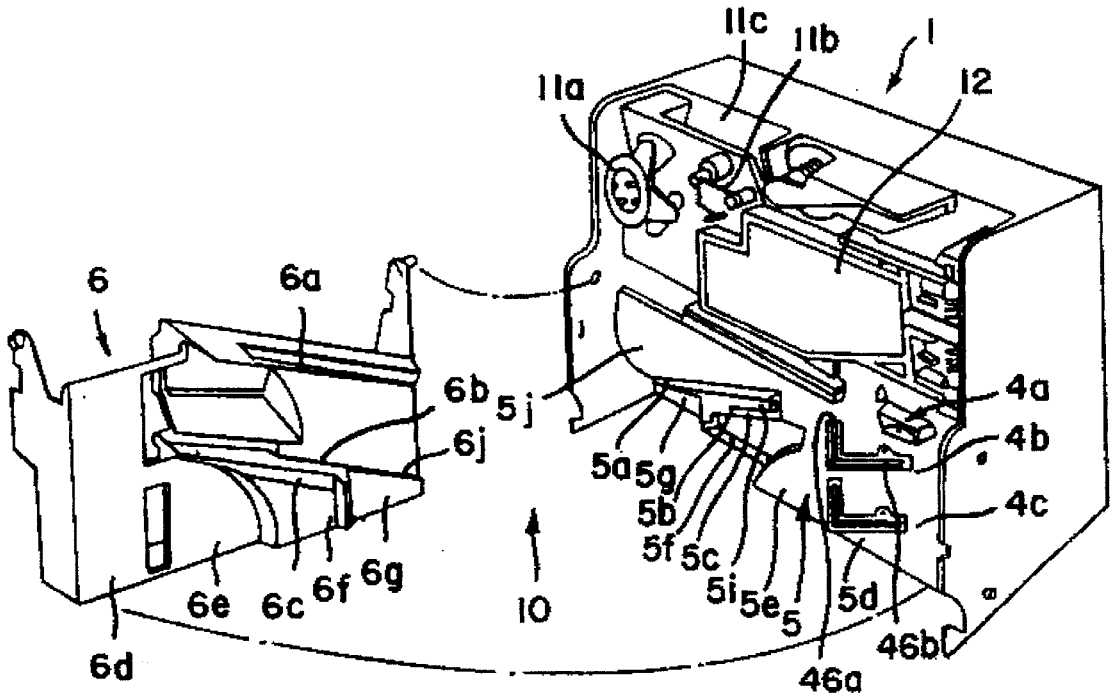
FIG. 3

FIG. 4B
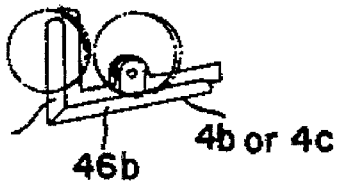
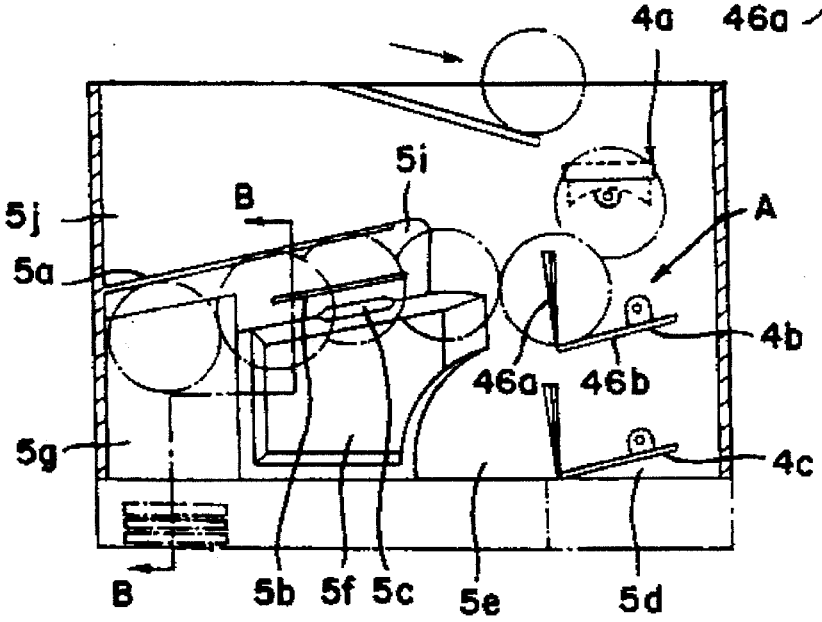
FIG. 4A
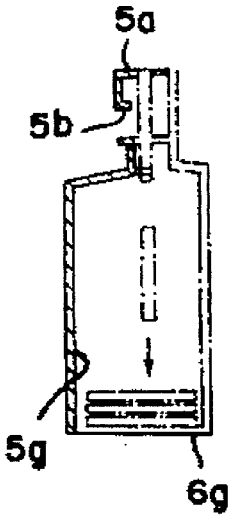
FIG. 4C
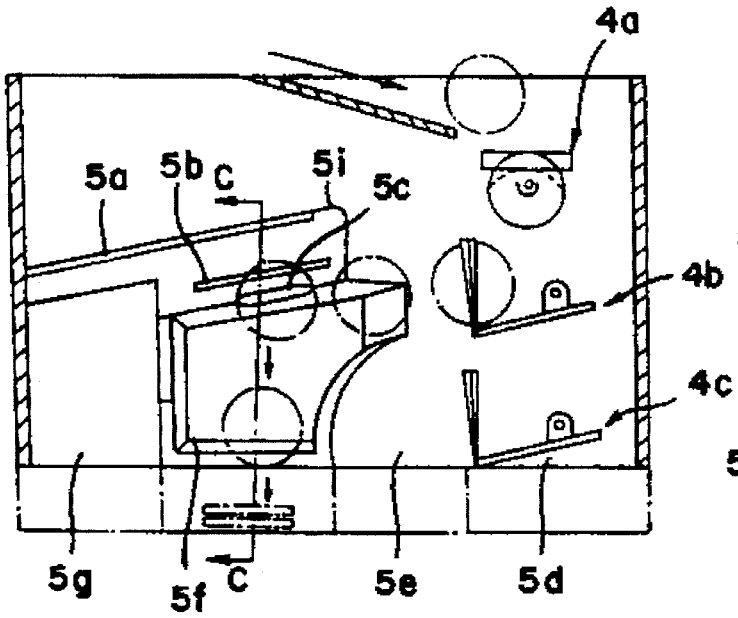
FIG. 5A
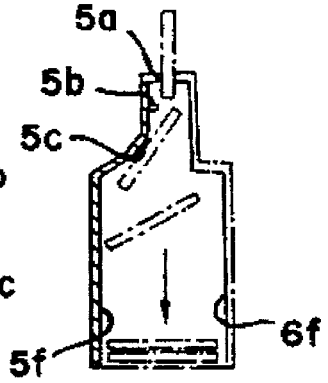
FIG. 5B FIG. 6A
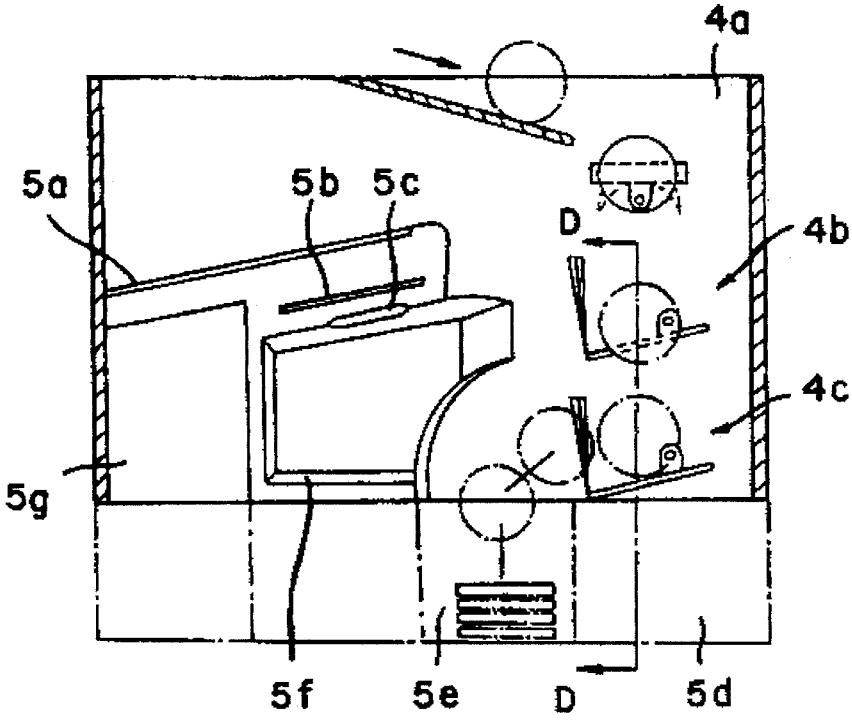
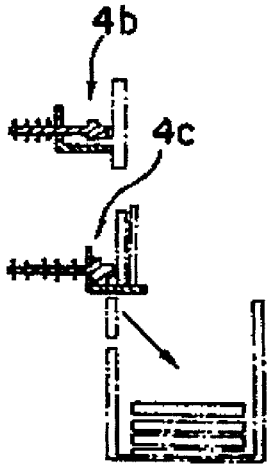
FIG. 6B
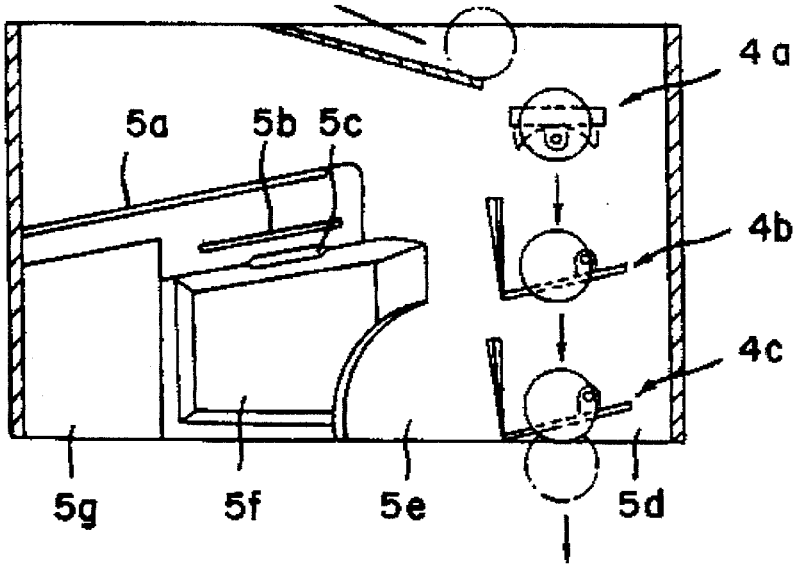
FIG. 7

COIN TREATMENT APPARATUS

BACKGROUND OF THE INVENTION

1. Field of the Invention

The present invention relates to a coin treatment apparatus, used in various apparatuses operated by coins, such as automatic vending machines and public telephones. More particularly the coin treatment apparatus of the present invention selects various coins on the basis of their currency units with different diameters, transfers them into a receiving space, and discharges those stored in the receiving space into a coin receiving box. This receiving box serves as another receiving space when a user finishes use of the apparatus.

2. Description of Related Art

Generally, a coin treatment apparatus sorts out the coins into each currency unit, selects them on the basis of the sorted information, and transfers them into a coin receiving space. At the bottom of the coin receiving space, a discharge plate for discharging a change and a path with a larger diameter than that of the coin to be received into the coin receiving space are formed. Therefore, the coins received in the receiving space are discharged through the path according to the linear movement of the discharge plate.

However, such conventional coin treatment apparatuses have complicated constructions because the mechanisms for selecting the coins on the basis of their currency units, sorting the correct coins from the incorrect coins, and transferring the selected coins to the receiving space, are installed and operate independently of each other. Therefore, the disadvantages with these conventional coin treatment apparatuses is that they frequently malfunction.

SUMMARY OF THE INVENTION

An object of the present invention is to provide a coin treatment apparatus, which selects coins on the basis of each currency unit, transfers the coins to the corresponding receiving space, and collects the coins stored in the receiving space into another receiving box at the same time, in order to .easily collect the coins.

For achieving the above objective, various gates are installed, as many as the number of currency units, the gates are changed in the vertical or horizontal direction to select the coins by each currency unit according to the coin discrimination information and to transfer the coins to the corresponding receiving space, and paths through which the coins are moved are formed on one side of an arbitrary gate among the gates. Therefore, the coins of the smaller diameter among the coins passing through the paths fall down to the corresponding receiving space of each currency unit so that the remaining coins are selected again.

Moreover, a removing plate which moves in the opposite direction to that of a discharge plate discharging the coins is installed at the bottom of the discharge plate. Therefore, all the coins stored in various receiving spaces are removed at the same time and fall down to another receiving box.

According to the present invention, since the selection and transfer of the coins can simultaneously be performed, the coin treatment apparatus can be simplified so that the breakdown of the apparatus and the occurrence of the malfunction is reduced. Additionally, since the removing plate performs linear reciprocating motion, all the coins stored in the receiving containers are simultaneously removed to another receiving box so that the collection of the coins is easily made.

BRIEF DESCRIPTION OF THE DRAWING

For fuller understanding of the nature and objects of the invention, reference should be had to the following detailed description taken in conjunction with the accompanying drawings in which:

FIG. 2 is a front view of FIG. 1,

FIG. 3 is an exploded perspective view of a selection box of FIG. 1,

FIG. 4A is a front view of the selection box illustrating a selection procedure for a coin, FIG. 4B is a detailed perspective view of part "A" of FIG. 4A, FIG. 4C is a sectional view taken along line B—B of FIG. 4A, FIG. 5A is a front view of the selection box illustrating a selection procedure for another coin, FIG. 5B is a sectional view taken along line C—C of FIG. 5A, FIG. 6A is a front view of the selection box illustrating a selection procedure for another coin, FIG. 6B is a sectional view taken along line D—D of FIG. 6A, FIG. 7 is a front view of the selection box illustrating a selection procedure for a fourth coin.

DETAILED DESCRIPTION OF A PREFERRED EMBODIMENT

The present invention now will be explained in detail by referring to the accompanying drawings.

Figure 1:
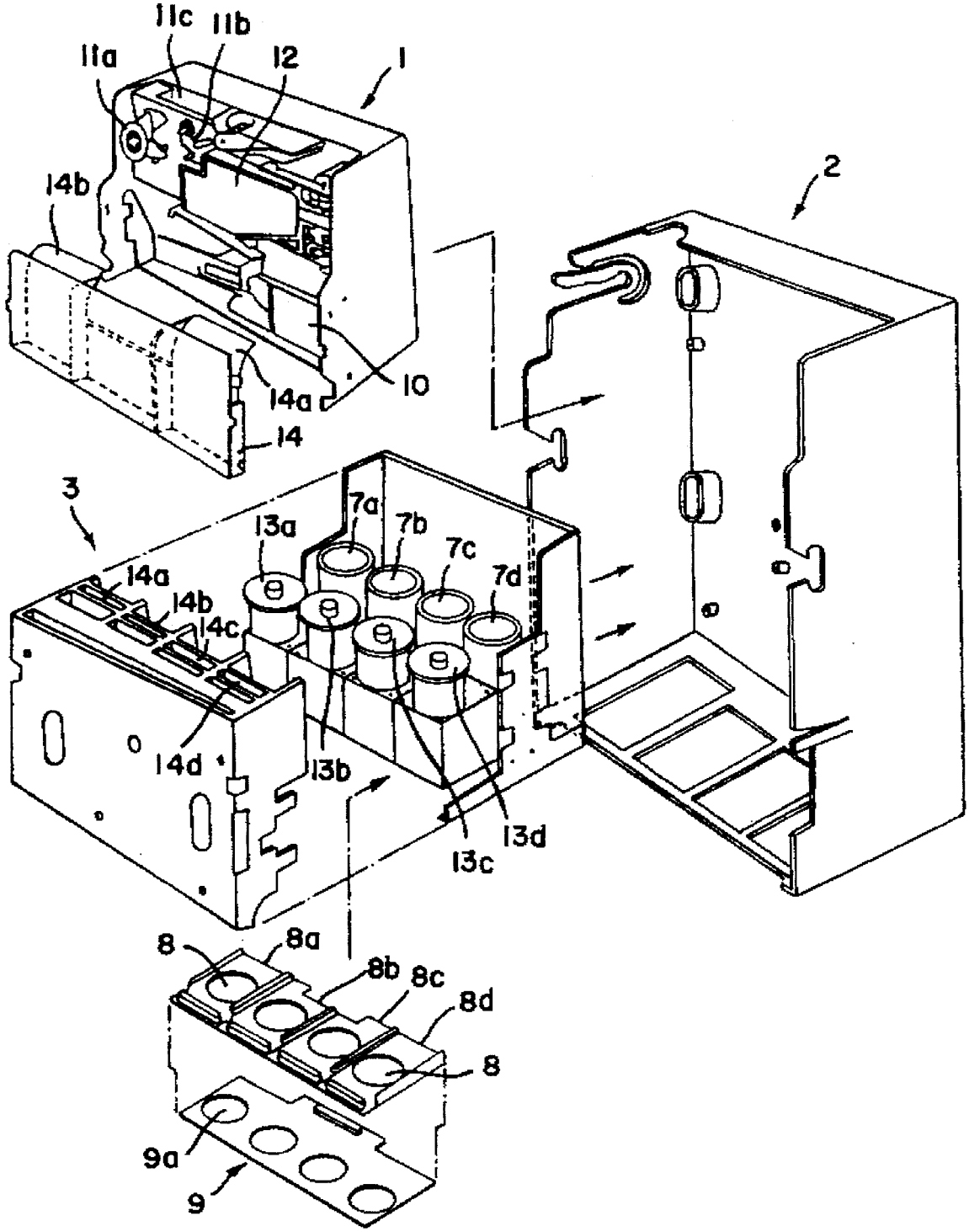
FIG. 1 is a totally exploded perspective view of the present invention.

Referring to FIGS. 1 and 2, a selection box 1 for selecting coins by sorting out whether the inserted coins are correct or incorrect and for transferring them to a receiving space installed in a case 2, and at the bottom of the selection box 1, a receiving box 3 for storing the coins passing the selection box 1 and for discharging change is installed in the receiving space.

As shown in FIGS. 1 to 3, the selection box 1 dampers dampers 11*a*, 11*b* for reducing the momentum of the inserted coin, a sorter section 12 for sorting out whether the inserted coins are correct or incorrect, and a selecting and transferring section 10 for selecting the coins passing the sorter section 12 as each currency unit and for transferring them to the receiving space. The dampers 11*a*, 11*b* and sorter section 12 are made of conventional materials, and especially the sorter section 12 is made of a usual sorter sensor for sorting out whether the inserted coins are correct or incorrect, or a sorter sensor of the coin size.

In the selecting and transferring section 10, a cover 6 is assembled on a base 5 which is a part of the body of the selection box 1, a returning lid 14 is installed on one side of the cover 6, and gates and coin transfer paths for selecting the coin passing the sorter section 12 by each currency unit are installed on the base 5.

A first gate 4*a*, a second gate 4*b* and a third gate 4*c* are installed to be sequentially arranged in accordance with the currency units of the normally used coins, for example, 500 Won, 100 Won, 50 Won, and 10 Won coins, and additional gates can be installed in case where the currency units are increased in addition to the above coins.

On the base 5, the first gate 4*a* and the third gate 4*c* are installed to be projected from the base 5, and a horizontal control piece 46*a* and a vertical control piece 46*b* are formed to be integrally connected with the second gate 4*b* and the third gate 4*c*.

The second gate 4*b* is positioned in the same direction as the falling direction of the coins. But, in the case where the second gate 4*b* is projected from the base 5, the second gate 4*b* has a predetermined gap between itself and the base 5 for horizontally transferring the coins. If the second gate 4*b* is embedded into the base 5, the second gate 4*b* is closely brought to the base 5 in order to prevent the horizontal transfer of the coin. And if a vertical control piece 46*b* is projected from the base 5, the vertical control piece 46*b* is positioned in the vertical direction or inclined to the falling direction of the coins in such a way that the vertical control piece 46*b* horizontally transfers the coin by preventing the vertical movement of the falling coin. Moreover, in the case where the vertical control piece 46*b* is embedded into the base 5, the coins fall continuously because the falling coins do not impede the vertical movement of the coins. The third gate 4*c* is constructed in the same form as the second gate 4*b*.

A coin transfer-path through which the coin, passing between a horizontal control piece 46*a* and base 5, is horizontally moved is formed on one side of the second gate 4*b*. Therefore, for projecting a projection die 5*a* guiding the movement of the coin from the base 5, a front end 5*i* of the projection die 5*a* is further projected than a rear end and that the projection die 5*a* is inclined from the front end 5*i* toward the rear end.

When the cover 6 is closed, another projection die 6*a* on the cover 6 is formed at a position confronting the projection die 5*a*, by having a predetermined gap between the projection dies 5*a*, 6*a* so that the coins can be moved under the condition that the coins are projected from a gap. A guide jaw 6*b* is also formed on the cover 6 for transferring the coin which has passed the horizontal control piece 46*a*. The coin is moved in a horizontal direction by its own weight because the guide jaw 6*b* is formed to have the same inclination as that of the projection die 5*a*.

In order for the coin which is horizontally rolled through the guide jaw 6*b* falls down to a corresponding receiving space, the inclined surfaces 6*c*, 6*j* are formed on the guide jaw 6*b*, a push die 5*b* is projected at the bottom of the projection die 5*a*, and the inclined surfaces 5*j*, 5*c* are formed on the base 5 in such a way that the inclined surfaces 5*c*, 6*c* and 5*j*, 6*j* face each other.

Receiving container entrances 14*a*, 14*b*, 14*c*, 14*d* are connected to the bottom end of the projection die 5*a* of the base 5 and the bottom end of the guide jaw 6*b* of the cover 6, the falling sections 5*d*, 5*e*, 5*f*, 5*g* and 6*d*, 6*e*, 6*f*, 6*g* behind paths through which each coin falls down are formed, and gaps are formed between the falling sections 5*d*, 5*e*, 5*f*, 5*g* and 6*d*, 6*e*, 6*f*, 6*g* for falling down of the coins.

As shown in FIGS. 1 and 2, for guiding the coins which falls down from the selection box 1 to the corresponding receiving containers 7*a* to 7*d*, the receiving container entrances 14*a* to 14*d* are formed on top of the receiving box 3 where the receiving container entrances 14*a* to 14*d* are formed to correspond to the falling section 5*d* to 5*g* and 6*d* to 6*g*, and the receiving containers 7*a* to 7*d* which are the receiving spaces for storing the coins are installed at the bottom of the receiving container entrances 14*a* to 14*d*. For linear reciprocating motion of the discharge plates 8*a* to 8*d*, motors 13*a*, 13*b* are installed on one side of the receiving container 7*a* to 7*d* for closing and opening the bottom surfaces of the receiving containers 7*a* to 7*d* in order to discharge the change.

Figure 8:
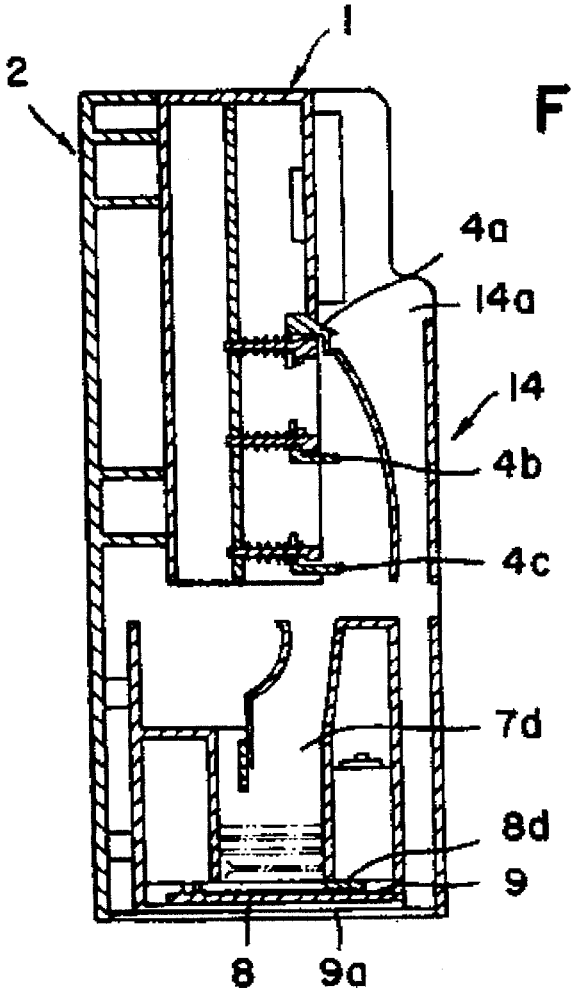
FIG. 8 is a sectional view taken along line E—E of FIG. 2.
Figure 9:
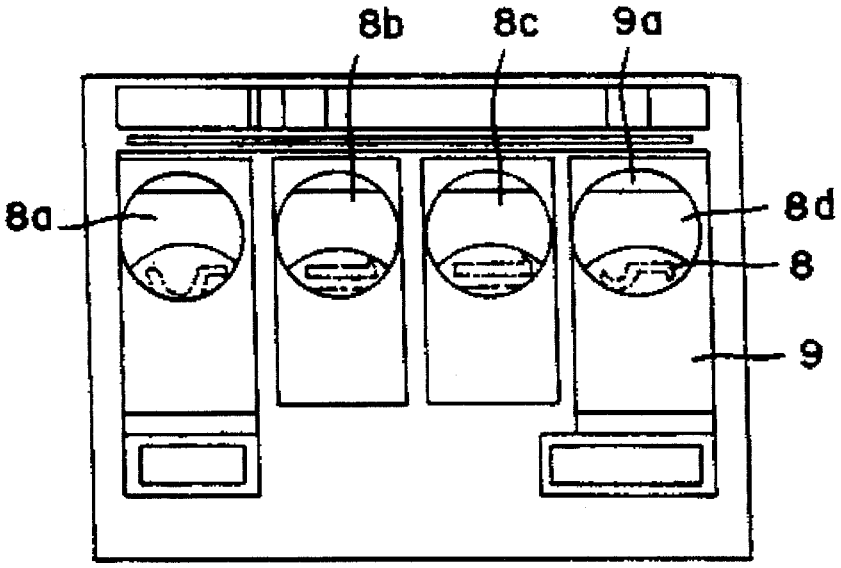
FIG. 9 is a bottom view of the present invention.

As shown in FIGS. 1, 8 and 9, the discharge plates 8*a* to 8*d*, used for closing and opening the receiving containers 7*a* to 7*d*, are installed at the bottom of the receiving container 7*a* to 7*d* in correspondence with the receiving containers 7*a* to 7*d*, and the discharge plates 8*a* to 8*d* are connected to each of the motors 13*a* to 13*d*. As a result, the discharge plates 8*a* to 8*d* move linearly.

The holes 9*a* of the removing plate 9 for discharging all the coins stored in the receiving containers 7*a* to 7*d* at the same time are positioned at the bottom of the discharge plates 8*a* to 8*d* to be partially superposed and the removing plate 9 is connected to another motor so that it moves linearly.

Among the above construction of the coin treatment apparatus, the number of gates 4*a* to 4*c* and the falling sections 5*d* to 5*g* are adjusted according to the currency units of the coins being used. In the accompanying drawings, four currency units (500 Won, 100 Won, 50 Won, and 10 Won) are shown.

A description of the acting effect of the present invention described above will now be given. When coins are inserted into a coin insertion hole, momentum and speed of the inserted coins are reduced in dampers 11*a*, 11*b*. Thereafter, the coins pass through the sorter section 12 sorting out whether the inserted coins are correct or incorrect and four currency units (500 Won, 100 Won, 50 Won and 10 Won) are sorted out.

The mechanism equipped in the present invention is driven through a separate central control unit according to the sorted information, and the coins are transferred to the receiving space after the coins are completely sorted out.

At this time, if the coins are not sorted as a normal coin by the sorter section 12, the first gate 4*a* remains in a condition of projection as shown in FIG. 8 so that the coins are inclined at the first gate 4*a* and enter a return hole 14*a* of the returning lid 14 to be discharged to the outside. If the coin is sorted as a normal coin by the sorter section 12, the first gate 4*a* is embedded into the base 5 as shown in FIGS. 4A, 5A, 6A, and 7. As a result, the coins fall down.

FIGS. 4A, 5A, 6A, and 7 are front views of the selection section for selecting and passing various coins. In cases where the coin passing through the first gate 4*a* as described above is 500 Won, it falls down onto the vertical control piece 46*b* of the second gate 4*b* projected from the base 5 by being controlled according to the sorter information of the sorter section 12, and passes between the horizontal control piece 46*a* and the base 5 after being moved in the horizontal direction by the inclination of the vertical control piece 46*b* and by its own weight, and then rolls down onto the guiding jaw 6*b*. At this time, since the coin rolls down on the guiding jaw 6*b* with the top end of the coin inserted in the gap of the projection die 6*a*, 5*a*, the coin is moved to the rear end of the projection die 6*a*, 5*a*, and then is inclined by the inclined surface 5*j*, 6*j*, and then falls down on to the falling section 5*g*, 6*g*.

In the case where the coin passing through the sorter section 12 is 100 Won, the first gate 4*a* is embedded into the base 5 according to the sorter information of the sorter section 12, and the coin passes through the first gate 4*a* and falls down on the vertical control piece 46*b* of the second gate 4*b*. Thereafter, the coin falls down on the falling section 5*f*, 6*f*.

In the case where the falling coin is 10 Won, the coin passes through between the horizontal control piece 46*a* of the second gate 4*b* and the base 5 and then falls down on the falling section 5*e*, 6*e* as shown in FIG. 6A. In the case where the falling coin is 50 Won, since the third gate 4*c* is embedded into the base 5, the coin passes through the first gate 4*a* to the third gate 4*c* and then falls down on the falling section 5*d*, 6*d* as shown in FIG. 7.

Thereafter, the coins falling down through the falling section 5*d* to 5*g* and 6*d* to 6*g* pass through the receiving container entrance 14*a* to 14*d* and pile up in the receiving containers 7*a* to 7*d*.

If the usage of the apparatus is completed, the change is discharged from the coins piled up in the receiving containers 7*a* to 7*d*.

FIG. 8 is a sectional view taken through line E—E of FIG. 2 and FIG. 9 shows the bottom view of the apparatus according to the present invention.

As shown in FIG. 8, if the change is determined by the additional central control unit, the motor 13*d* is driven by the additional central control unit and the discharge plate 8*d* at the bottom of the receiving container 7*d* slides by the motor 13*d* and at this time, the hole 8 of the discharge plate 8*d* coincides with the hole 9*a* of the removing plate 9 during the linear movement of the discharge plate 8*d* so that the coin inserted in the hole 8 of the discharge plate 8*d* is discharged to the outside through the hole 9*a*.

When it is necessary to discharge all the coins stored in each receiving container 7*a* no 7*d* at the same time, if the removing plate 9 is withdrawn, the holes 9*a* of the removing plate 9 and the holes 8 of the discharge plates 8*a* to 8*d* coincide with each other so that all the coins stored in the receiving containers 7*a* to 7*d* are discharged.

In the operation procedures described above, if the coin does not pass through each gate 4*a*, 4*b* and 4*c* and is laid across the gate 4*b* and 4*c*, an additional sensor installed inside the base 5 discriminates it and the gates 4*a*, 4*b* and 4*c* is continually operated. Therefore, the coin is moved.

While the invention has been described with respect to a preferred embodiment, it will be understood by those skilled in the art that various changes in detail may be made therein without departing from the spirit, scope and teaching of the invention.

What is claimed is:

1. A coin treatment apparatus, having a selection box for selecting coins by sorting out whether such coins are correct or incorrect, said correct and incorrect coins being sized in accordance with specific currency units, a receiving space into which said incorrect coins are transferred, and a receiving box for storing said correct coins, once passed through said selection box, the apparatus further comprising:

a base;

a cover adapted to said base;

a plurality of gates oriented substantially vertically to each other;

means attached to said base and said gates for projecting said gates from said base, said projecting means being in accordance with the currency unit of each of said correct coins;

each of said gates for receiving at least one currency unit of said correct coins traveling in a substantially vertical direction, and transferring said correct coins to a substantially horizontal direction of travel;

a plurality of projection dies and at least one guiding jaw formed by said base and said cover within said selection box, wherein said projection dies and said at least one guiding jaw form a coin transfer path for receiving said correct coins from said respective gates along said substantially horizontal direction of travel and further separating said correct coins based on a first diameter; and at least one push die and at least one inclination surface formed by said base and said cover, wherein said push die and said inclination surface incline said correct coins having diameters smaller than said first diameter along said coin transfer path in order to fall down into said receiving box;

said receiving box additionally comprising:

a bottom side and a plurality of receiving containers having first openings;

a removing plate in communication with a discharge plate at the bottom side of said receiving box, both said removing plate and said discharge plate including second openings being sized to correspond with said first openings of said receiving containers within said receiving box; and means for linearly reciprocating said removing plate and said discharge plate in opposite directions.

2. The apparatus of claim 1, wherein said selection box additionally comprises:

a plurality of dampers for reducing the momentum of said coins, a sorter section for sorting out whether said coins are correct or incorrect, and means for selecting and transferring the coins passing through said sorter section by their respective currency unit.

3. The apparatus of claim 1, wherein said at least two of said plurality of gates including, a horizontal member for controlling the movement of said correct coins in the horizontal direction, said member including a gap between said horizontal member, and a vertical control member for controlling the vertical movement of said correct coins.

4. The apparatus of claim 1, wherein said removing plate is formed by a single plate.

5. A coin treatment apparatus, having a selection box for selecting coins by sorting out whether such coins are correct or incorrect, said correct and incorrect coins being sized in accordance with specific currency units, said selection box comprising:

a plurality of dampers for reducing the momentum of said coins;

a sorter section for sorting out whether said coins are correct or incorrect; and means for selecting and transferring the coins passing through said sorter section by their respective currency unit;

a receiving space into which said incorrect coins are transferred, and a receiving box for storing said correct coins, once passed through said selection box, the apparatus further comprising:

a base;

a cover adapted to said base;

a plurality of gates oriented substantially vertically to each other;

means attached to said base and said gates for projecting said gates from said base, said projecting means being in accordance with the currency unit of each of said correct coins;

each of said gates for receiving at least one currency unit of said correct coins traveling in a substantially vertical direction, and transferring said correct coins to a substantially horizontal direction of travel;

a plurality of projection dies and at least one guiding jaw formed by said base and said cover within said selection box, wherein said projection dies and said at least one guiding jaw form a coin transfer path for receiving said correct coins from said respective gates along said substantially horizontal direction of travel and further separating said correct coins based on a first diameter; and at least one push die and at least one inclination surface formed by said base and said cover, wherein said push die and said inclination surface incline said correct coins having diameters smaller than said first diameter along said coin transfer path in order to fall down into said receiving box;

said receiving box additionally comprising:

a bottom side and a plurality of receiving containers having first openings;

a removing plate in communication with a discharge plate at the bottom side of said receiving box, both said removing plate and said discharge plate including second openings being sized to correspond with said first openings of said receiving containers within said receiving box; and means for linearly reciprocating said removing plate and said discharge plate in opposite directions.

6. The apparatus of claim 5, wherein said removing plate is formed by a single plate.

7. A coin treatment apparatus, having a selection box for selecting coins by sorting out whether such coins are correct or incorrect, said correct and incorrect coins being sized in accordance with specific currency units, and transferring said incorrect coins to a corresponding receiving space, and said correct coins to a receiving box for storing the correct coins, comprising:

a base;

a cover adapted to said base;

a plurality of gates;

means attached to said base and said gates for projecting said gates from said base, said projections being in accordance with the currency unit of each of said correct coins;

each of said gates for receiving at least one currency unit of said correct coins traveling in a substantially vertical direction, and transferring said correct coins to a substantially horizontal direction of travel;

a plurality of projection dies and at least one guiding jaw formed by said base and said cover within said selection box, wherein said projection dies and said at least one guiding jaw form a coin transfer path for receiving said correct coins from said respective gates along said substantially horizontal direction of travel and further separating said correct coins based on a first diameter;

at least one push die and at least one inclination surface formed by said base and said cover, wherein said push die and said inclination surface incline said correct coins having diameters smaller than said first diameter along said coin transfer path in order to fall down into said receiving box;

said receiving box including a bottom side and a plurality of receiving containers having first openings, said receiving box further comprising:

a removing plate in communication with a discharge plate at the bottom side of said receiving box, both said removing plate and said discharge plate including second openings being sized to correspond with said first openings of said receiving containers within said receiving box; and means for linearly reciprocating said removing plate and said discharge plate in opposite directions.

8. The apparatus of claim 7, wherein said removing plate is formed by a single plate.

9. A coin treatment apparatus, having a selection box for selecting coins by sorting out whether such coins are correct or incorrect, said correct and incorrect coins being sized in accordance with specific currency units, and transferring said incorrect coins to a corresponding receiving space, and said correct coins to a receiving box for storing the correct coins, comprising:

a plurality of dampers for reducing the momentum of said coins, a sorter section for sorting out whether said coins are correct or incorrect, means for selecting and transferring said coins passing through said sorter section by their respective currency unit;

a base;

a cover adapted to said base;

a plurality of gates;

means attached to said base and said gates for projecting said gates from said base, said projections being in accordance with the currency unit of each of said correct coins;

each of said gates for receiving at least one currency unit of said correct coins traveling in a substantially vertical direction, and transferring said correct coins to a substantially horizontal direction of travel;

a plurality of projection dies and at least one guiding jaw formed by said base and said cover within said selection box, wherein said projection dies and said at least one guiding jaw form a coin transfer path for receiving said correct coins from said respective gates along said substantially horizontal direction of travel and further separating said correct coins based on a first diameter;

at least one push die and at least one inclination surface formed by said base and said cover, wherein said push die and said inclination surface incline said correct coins having diameters smaller than said first diameter along said coin transfer path in order to fall down into said receiving box;

said receiving box including a bottom side and a plurality of receiving containers having first openings, said receiving box further comprising:

a removing plate in communication with a discharge plate at the bottom side of said receiving box, both said removing plate and said discharge plate including second openings being sized to correspond with said first openings of said receiving containers within said receiving box; and means for linearly reciprocating said removing plate and said discharge plate in opposite directions.

10. The apparatus of claim 9, wherein said removing plate is formed by a single plate.

* * * * *